US009936854B2

(12) United States Patent
Boyer

(10) Patent No.: US 9,936,854 B2
(45) Date of Patent: Apr. 10, 2018

(54) BOTTLE WASHER ASSEMBLY FOR DISHWASHER APPLIANCE

(71) Applicant: General Electric Company, Schenectady, NY (US)

(72) Inventor: Joel Charles Boyer, Louisville, KY (US)

(73) Assignee: Haier US Appliance Solutions, Inc., Wilmington (DE)

( * ) Notice: Subject to any disclaimer, the term of this patent is extended or adjusted under 35 U.S.C. 154(b) by 102 days.

(21) Appl. No.: 14/794,103

(22) Filed: Jul. 8, 2015

(65) Prior Publication Data

US 2017/0007094 A1 Jan. 12, 2017

(51) Int. Cl.

| | |
|---|---|
| ***A47L 15/50*** | (2006.01) |
| ***A47L 15/42*** | (2006.01) |
| *B05B 1/32* | (2006.01) |

(52) U.S. Cl.

CPC ..... *A47L 15/505* (2013.01); *A47L 15/4278* (2013.01); *A47L 15/503* (2013.01); *A47L 15/508* (2013.01); *B05B 1/32* (2013.01)

(58) Field of Classification Search

CPC .. A47L 15/4278; A47L 15/505; A47L 15/503; A47L 15/50; F16K 5/04; F16K 5/0407; F16K 5/20; F16K 31/563; F16K 31/58; B05B 1/32; B05B 1/323; B05B 1/326

USPC ..... 222/402.1, 402.11, 402.14, 402.19, 222/402.21, 402.23; 239/537, 538, 457, 239/458, 579

See application file for complete search history.

(56) References Cited

U.S. PATENT DOCUMENTS

| | | | | |
|---|---|---|---|---|
| 2,717,726 A * | 9/1955 | Mart | B65D 47/305 | 222/498 |
| 3,593,961 A * | 7/1971 | Stewart | F16K 31/58 | 251/341 |
| 4,589,445 A * | 5/1986 | Sanchez Aguilar | F16K 3/08 | 137/615 |
| 5,316,218 A | 5/1994 | Bowen | | |
| 5,657,928 A * | 8/1997 | Jian | B05B 1/3026 | 239/242 |

(Continued)

FOREIGN PATENT DOCUMENTS

| | | |
|---|---|---|
| DE | 19847151 A1 * | 4/2000 |
| EP | 0997100 A1 | 5/2000 |
| EP | 2225996 A1 | 9/2010 |

OTHER PUBLICATIONS

Machine translation of DE 19847151 A1, dated Apr. 2000.*

*Primary Examiner* — Michael E Barr
*Assistant Examiner* — Kevin G Lee
(74) *Attorney, Agent, or Firm* — Dority & Manning, P.A.

(57) ABSTRACT

Bottle washer assemblies for dishwasher appliances are provided. A bottle washer assembly includes a main conduit defining a main passage for flowing wash fluid therethrough. The bottle washer assembly further includes a spray tine, the spray tine including a conduit defining a passage for flowing wash fluid therethrough. The passage is in selective fluid communication with the main passage. The conduit is movable between a first position wherein wash fluid flow into the passage is permitted and a second position wherein wash fluid flow into the passage is restricted relative to the wash fluid flow in the first position.

17 Claims, 7 Drawing Sheets

(56) References Cited

U.S. PATENT DOCUMENTS

| | | | | |
|---|---|---|---|---|
| 6,038,784 | A * | 3/2000 | Dunn | F26B 25/18 211/41.6 |
| 7,097,078 | B2 * | 8/2006 | Sanchez | B65D 83/206 222/402.21 |
| 7,422,036 | B2 | 9/2008 | Burrows et al. | |
| 7,475,696 | B2 | 1/2009 | Vanderroest | |
| 7,543,712 | B2 * | 6/2009 | Purushothaman | A47L 15/505 211/41.8 |
| 7,914,625 | B2 | 3/2011 | Bertsch et al. | |
| 7,918,942 | B2 | 4/2011 | Nagel et al. | |
| 7,969,772 | B2 | 6/2011 | Gubbins et al. | |
| 8,161,995 | B2 | 4/2012 | Armstrong et al. | |
| 2012/0291827 | A1 | 11/2012 | Buddharaju et al. | |
| 2015/0257623 | A1 * | 9/2015 | Beshears, Jr. | A47L 15/4282 134/172 |

* cited by examiner

BOTTLE WASHER ASSEMBLY FOR DISHWASHER APPLIANCE

FIELD OF THE INVENTION

The present subject matter relates generally to dishwasher appliances, and more particularly to bottle washer assemblies for use in dishwasher appliances.

BACKGROUND OF THE INVENTION

Dishwasher appliances generally include a tub that defines a wash chamber therein. Various spray assemblies may be disposed within the wash chamber. During operation of the dishwasher appliances, the spray assemblies direct wash fluid towards articles within rack assemblies in the wash chamber. Thus, the spray assemblies provide multiple outlets for directing wash fluid onto articles within the rack assemblies during operation of the dishwasher appliances.

In certain dishwasher appliances, a bottle washer assembly is provided as one of the spray assemblies. The bottle washer assembly generally includes spray tines through which wash fluid is flowed. Suitable articles, such as bottles, cups, glasses, etc., are provided on the bottle washer assembly such that, for example, an article generally surrounds a spray tine. Wash fluid ejected from the spray tine contacts and cleans the inside surface of the article.

One issue with many presently known bottle washer assemblies is the constant flow of wash fluid through and ejected from the assemblies. In cases when the bottle washer assemblies are not being utilized, wash fluid is still flowed through the bottle washer assemblies. This flow thus reduces the amount of wash fluid and the flow rate of wash fluid available to other spray assemblies in the dishwasher appliance, such as the lower, mid-level and upper spray assemblies.

An additional issue with many presently known bottle washer assemblies is the stationary nature of the spray tine in a typically vertical position. In cases when the bottle washer assemblies are not being utilized, the spray tines are maintained in their stationary positions and may thus be obtrusive to users attempting to load articles in the dishwasher assembly around the bottle washer assemblies.

Accordingly, improved bottle washer assemblies for are desired in the art. In particular, bottle washer assemblies having flow restriction features and which can be positioned unobtrusively when not in use would be advantageous.

BRIEF DESCRIPTION OF THE INVENTION

In accordance with one embodiment, a bottle washer assembly for a dishwasher appliance is provided. The bottle washer assembly includes a main conduit defining a main passage for flowing wash fluid therethrough. The bottle washer assembly further includes a spray tine, the spray tine including a conduit defining a passage for flowing wash fluid therethrough. The passage is in selective fluid communication with the main passage. The conduit is movable between a first position wherein wash fluid flow into the passage is permitted and a second position wherein wash fluid flow into the passage is restricted relative to the wash fluid flow in the first position.

In accordance with another embodiment, a dishwasher appliance is provided. The dishwasher appliance includes a tub defining a wash chamber, a rack assembly disposed within the wash chamber of the tub, a first spray assembly positioned adjacent the rack assembly, and a second spray assembly positioned adjacent the rack assembly. The second spray assembly is a bottle washer assembly. The bottle washer assembly includes a main conduit defining a main passage for flowing wash fluid therethrough. The bottle washer assembly further includes a spray tine, the spray tine including a conduit defining a passage for flowing wash fluid therethrough. The passage is in selective fluid communication with the main passage. The conduit is movable between a first position wherein wash fluid flow into the passage is permitted and a second position wherein wash fluid flow into the passage is restricted relative to the wash fluid flow in the first position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
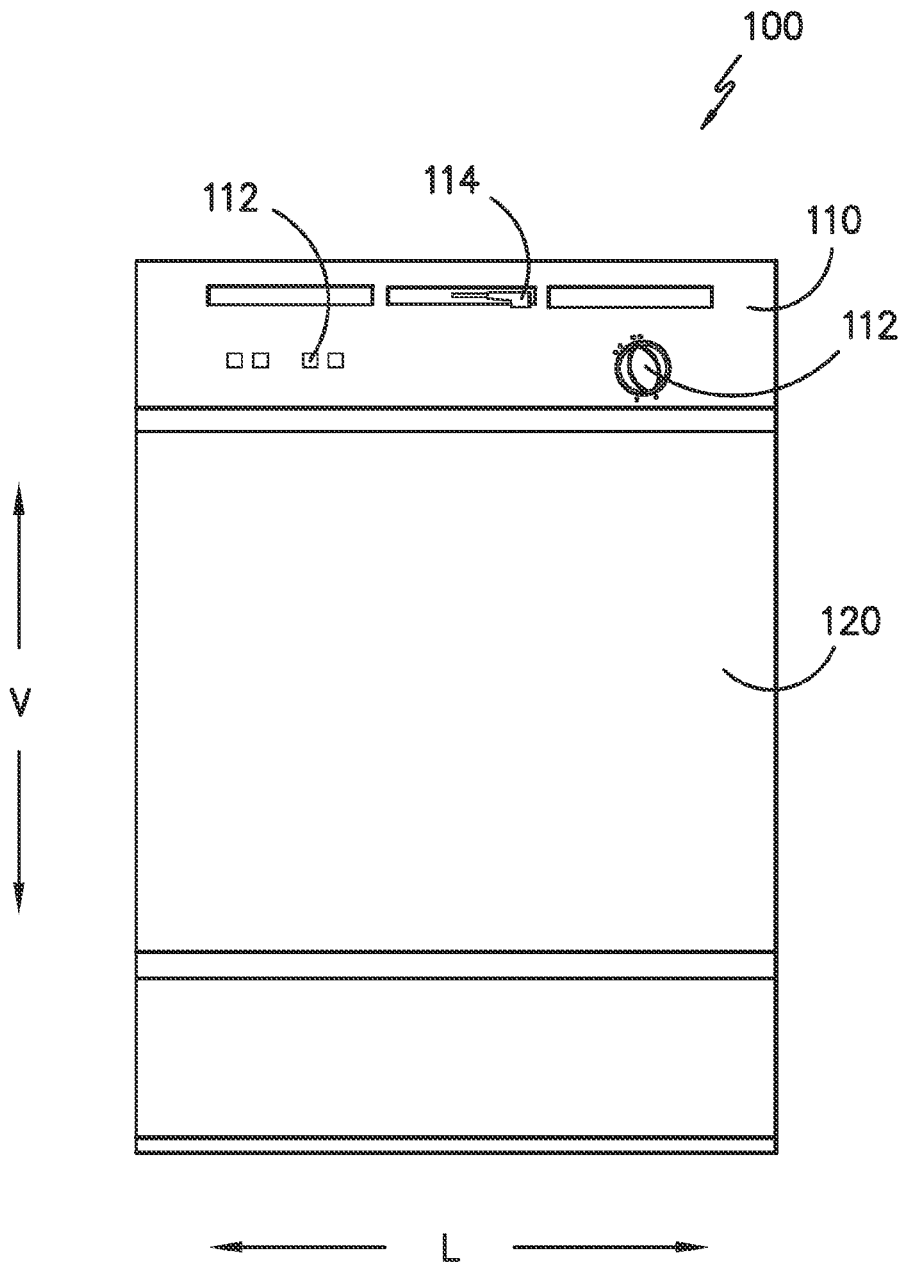
FIG. 1 provides a front elevation view of a dishwasher appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
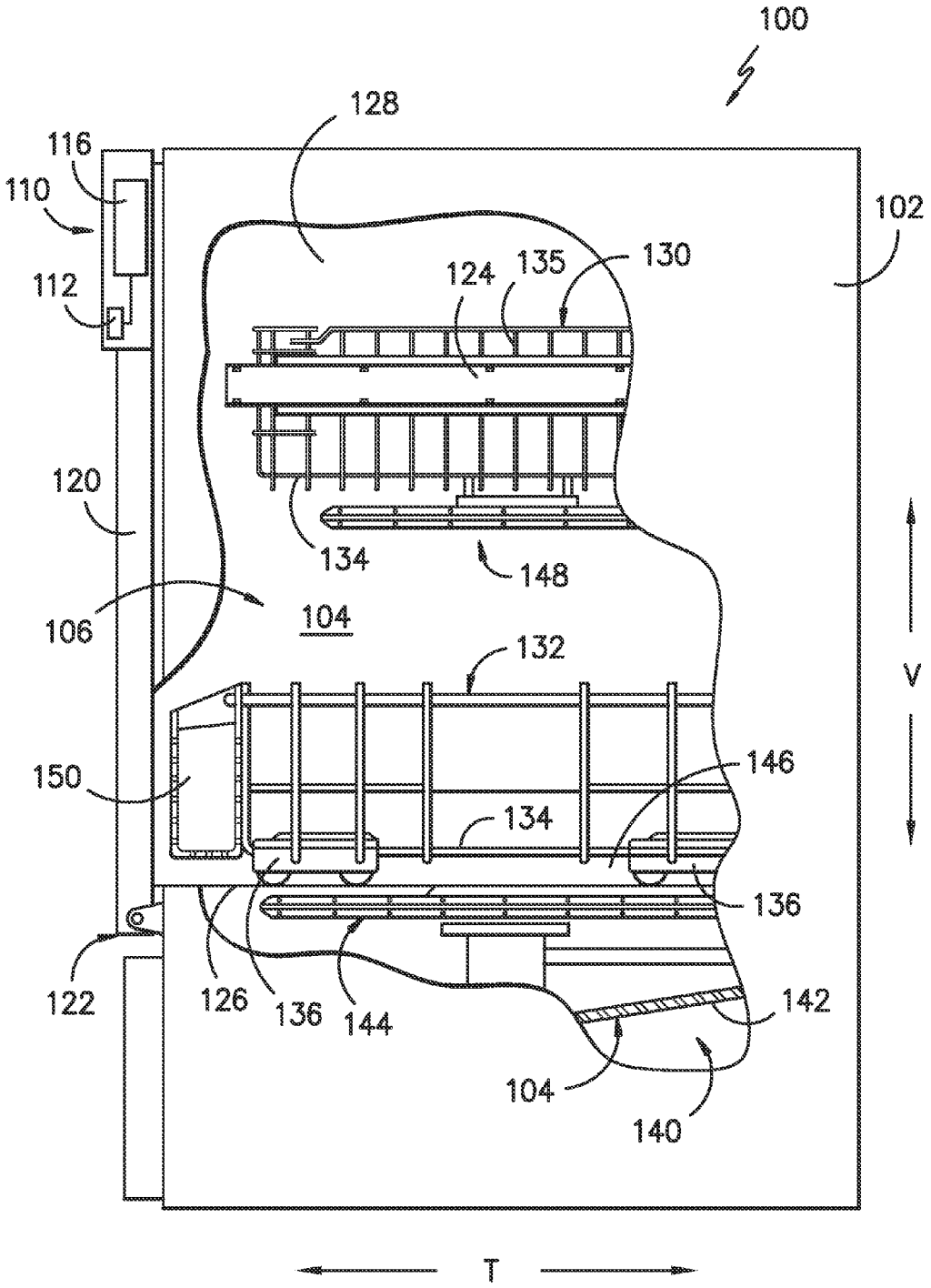
FIG. 2 provides a partial side section view of a dishwasher appliance in accordance with one embodiment of the present disclosure.

FIGS. 1 and 2 depict a dishwasher appliance 100 according to an exemplary embodiment of the present subject matter. Dishwasher appliance 100 defines a vertical direction V, a lateral direction L (FIG. 1) and a transverse direction T (FIG. 2). The vertical, lateral, and transverse directions V, L, and T are mutually perpendicular and form an orthogonal direction system.

Dishwasher appliance 100 includes a chassis or cabinet 102 having a tub 104. Tub 104 defines a wash chamber 106 and includes a front opening (not shown) and a door 120 hinged at its bottom 122 for movement between a normally closed vertical position (shown in FIGS. 1 and 2), wherein wash chamber 106 is sealed shut for washing operation, and a horizontal open position for loading and unloading of articles from dishwasher appliance 100. A latch 114 is used to lock and unlock door 120 for access to chamber 106.

Slide assemblies 124 are mounted on opposing tub sidewalls 128 to support and provide for movement of an upper rack assembly 130. Lower guides 126 are positioned in opposing manner of the sides of chamber 106 and provide a ridge or shelf for roller assemblies 136 so as to support and provide for movement of a lower rack assembly 132. Each of the upper and lower rack assemblies 130 and 132 is fabricated into lattice structures including a plurality of elongated members 134 and 135 that extend in lateral (L), transverse (T), and/or vertical (V) directions. Each rack assembly 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by slide assemblies 124 and roller assemblies 136 that carry the upper and lower rack assemblies 130 and 132, respectively. A silverware basket 150 may be removably attached to the lower rack assembly 132 for placement of silverware, small utensils, and the like, that are too small to be accommodated by the upper and lower rack assemblies 130, 132.

Dishwasher appliance 100 also includes a lower spray assembly 144 that is rotatably mounted within a lower region 146 of the wash chamber 106 and above a tub sump portion 142 so as to rotate in relatively close proximity to lower rack assembly 132. A spray arm or mid-level spray assembly 148 is located in an upper region of the wash chamber 106 and may be located in close proximity to upper rack assembly 130. Additionally, an upper spray assembly (not shown) may be located above the upper rack assembly 130 and mounted to an upper wall of tub 104.

Lower and mid-level spray assemblies 144, 148 and the upper spray assembly are fed by a fluid circulation assembly for circulating water and wash fluid in the tub 104. Portions of the fluid circulation assembly may be located in a machinery compartment 140 located below tub sump portion 142 of tub 104, as generally recognized in the art. Each spray assembly includes an arrangement of discharge ports or orifices for directing washing liquid onto dishes or other articles located in upper and lower rack assemblies 130, 132, respectively. The arrangement of the discharge ports in at least the lower spray assembly 144 provides a rotational force by virtue of washing fluid flowing through the discharge ports. The resultant rotation of lower spray assembly 144 provides coverage of dishes and other articles with a washing spray.

Dishwasher appliance 100 is further equipped with a controller 116 to regulate operation of dishwasher appliance 100. Controller 116 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 116 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 116 may be positioned in a variety of locations throughout dishwasher appliance 100. In the illustrated embodiment, controller 116 may be located within a control panel area 110 of door 120 as shown. In such an embodiment, input/output ("I/O") signals may be routed between the control system and various operational components of dishwasher appliance 100 along wiring harnesses that may be routed through bottom 122 of door 120. Typically, the controller 116 includes a user interface panel 112 through which a user may select various operational features and modes and monitor progress of the dishwasher appliance 100. In one embodiment, user interface panel 112 may represent a general purpose I/O ("GPIO") device or functional block. In one embodiment, the user interface panel 112 may include input components, such as one or more of a variety of electrical, mechanical or electro-mechanical input devices including rotary dials, push buttons, and touch pads. User interface panel 112 may include a display component, such as a digital or analog display device designed to provide operational feedback to a user. User interface panel 112 may be in communication with controller 116 via one or more signal lines or shared communication busses.

It should be appreciated that the present subject matter is not limited to any particular style, model, or configuration of dishwasher appliance. Thus, the exemplary embodiment depicted in FIGS. 1 and 2 is provided for illustrative purposes only. For example, different locations may be provided for a user interface 112, different configurations may be provided for upper and lower rack assemblies 130, 132 and/or lower and mid-level spray assemblies 144, 148, and other differences may be applied as well.

Figure 3:
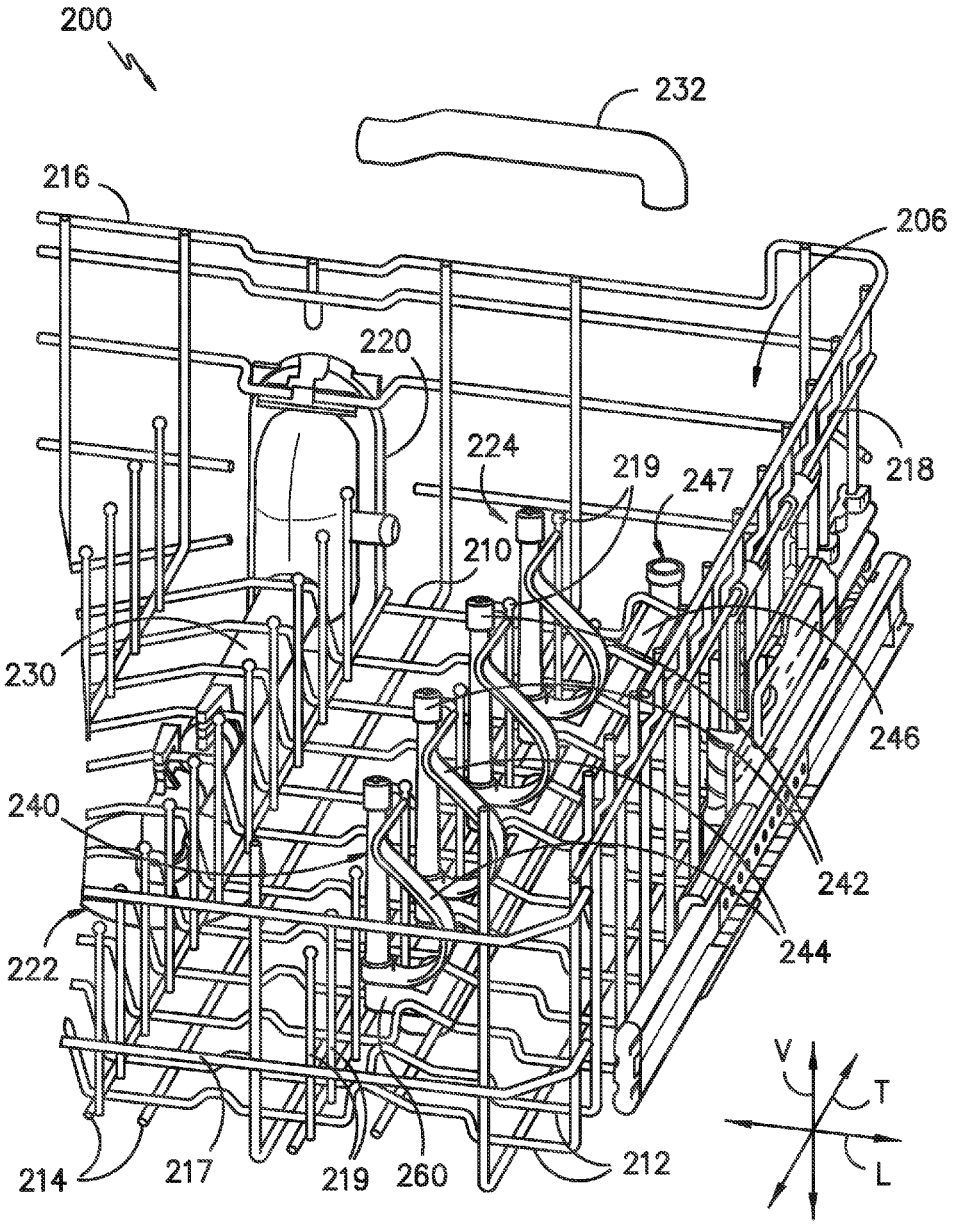
FIGS. 3 and 4 provide partial perspective views of a rack assembly in accordance with embodiments of the present disclosure.
Figure 4:
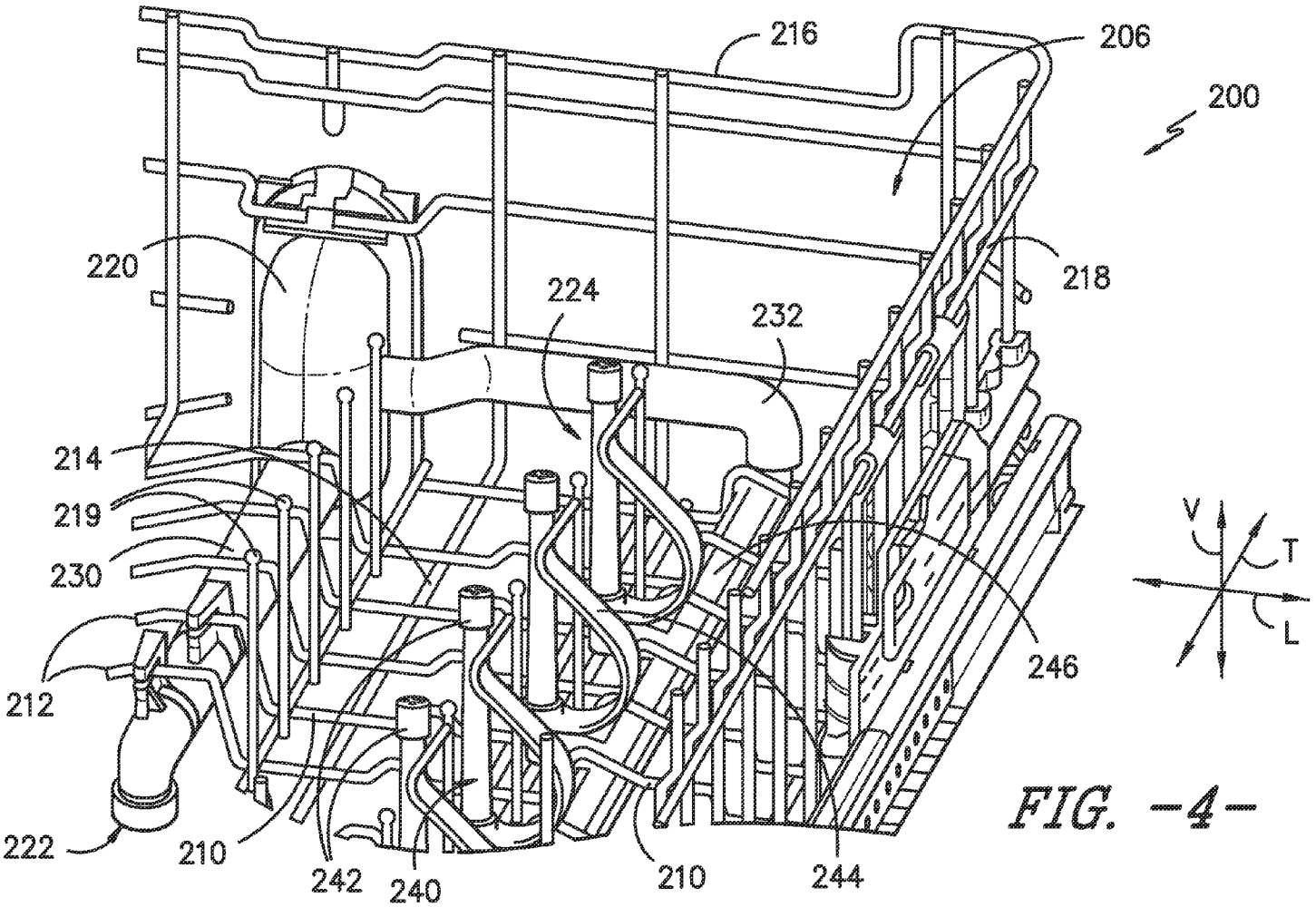
Figure 5:
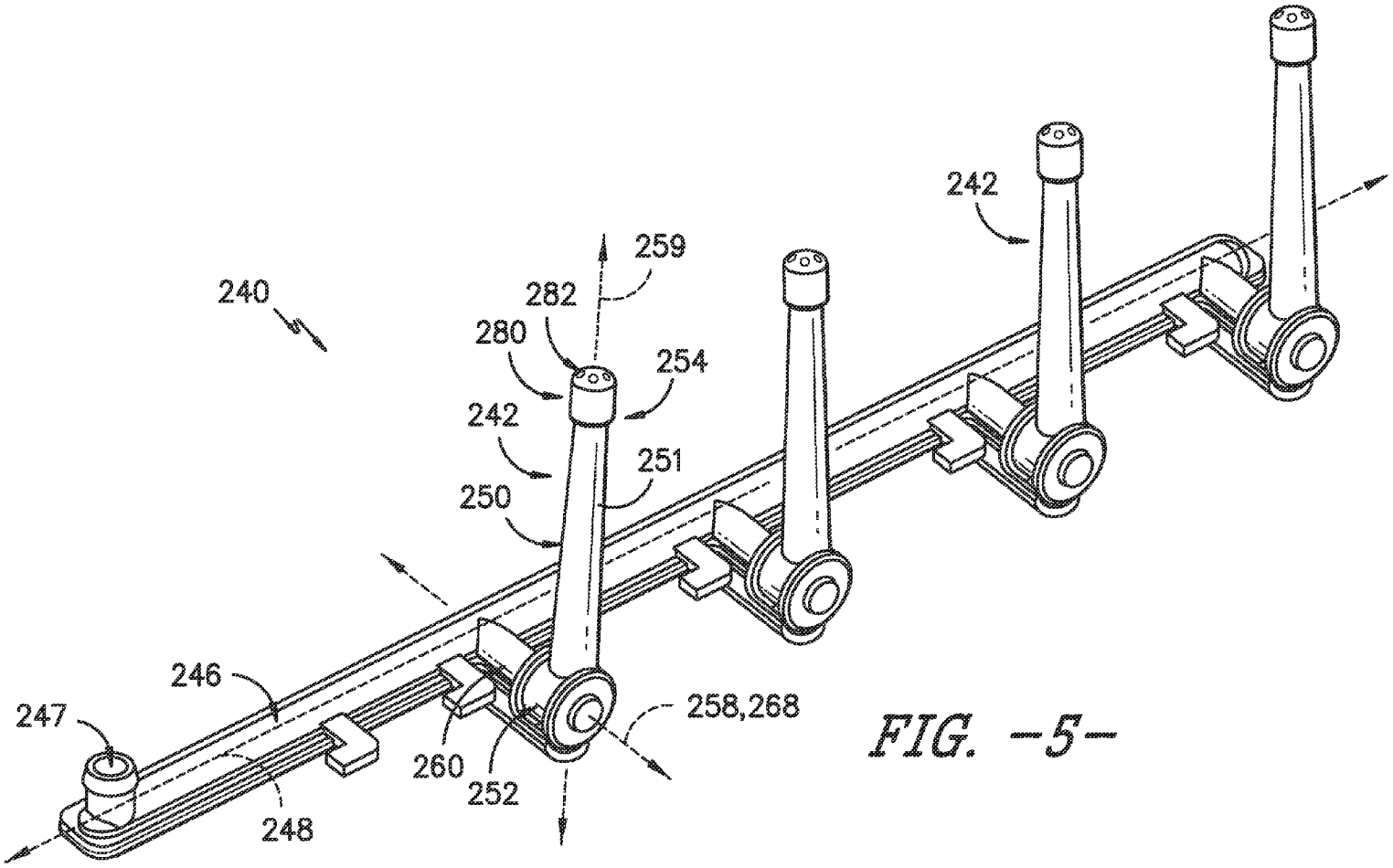
FIG. 5 provides a perspective view of a bottle washer assembly in accordance with one embodiment of the present disclosure.

FIGS. 3 and 4 illustrate partial perspective views of a rack assembly 200 according to an exemplary embodiment of the present subject matter. Rack assembly 200 may be used in any suitable dishwasher appliance. As an example, rack assembly 200 may be utilized in dishwasher appliance 100, e.g., as upper rack assembly 130 (FIG. 2) or alternatively as lower rack assembly 132. Rack assembly 200 may generally include features for directing flows of wash fluid into the wash chamber 106, such as generally towards rack assembly 200, as discussed in greater detail below.

As may be seen in FIGS. 3 and 4, rack assembly 200 defines an interior volume 206. In particular, a bottom wall 210, a back wall 216, a front wall 217 and side walls 218 (only one of which is shown) of rack assembly 200 may assist with defining interior volume 206 of rack assembly 200. Thus, interior volume 206 of rack assembly 200 may be defined between bottom wall 210, back wall 216, front wall 217 and side walls 218 of rack assembly 200. Articles for washing, such as cups, bowls, bottles, etc., may be placed or positioned within interior volume 206 of rack assembly 200 such that the articles for washing are supported by rack assembly 200 during operation of dishwasher appliance 100.

Rack assembly 200 can also include a plurality of tines 219, which as shown are fixed tines but alternatively may be rotatable tines, for assisting with supporting articles within interior volume 206 of rack assembly 200. Fixed tines 219 are mounted to bottom wall 210 of rack assembly 200 and extend into interior volume 206 of rack assembly 200, e.g., upwardly along the vertical direction V. In particular, as shown in FIGS. 3 and 4, bottom wall 210 may include a series of lateral members 212 fixed to a series of transverse members 214. Each lateral member of lateral members 212 extends along the lateral direction L. Lateral members 212 are also spaced apart from one another along the transverse direction T. Similarly, each transverse member of transverse members 214 extend along the transverse direction T. Transverse members 214 are also spaced apart from one another along the lateral direction L. Thus, lateral members 212 and transverse members 214 form a lattice structure for containing articles within rack assembly 200. Fixed tines 219 may be mounted or fixed (e.g., welded) to lateral members 212 and/or transverse members 214 of bottom wall 210 of rack assembly 200 and extend into interior volume 206 of rack assembly 200, e.g., upwardly along the vertical direction V, from bottom wall 210.

Rack assembly 200 further includes a first spray assembly 222 and a second spray assembly 224. First and second spray assemblies 222, 224 are positioned and oriented for directing respective flows of wash fluid into wash chamber 106, such as towards interior volume 206 of rack assembly 200. The flows of wash fluid from first and second spray assemblies 222, 224 can assist with cleaning articles within interior volume 206 of rack assembly 200, as will be understood by those skilled in the art. Thus, rack assembly 200 includes features for, e.g., selectively, directing multiple flows of washing fluid into interior volume 206 of rack assembly 200.

First spray assembly 222 is positioned and/or oriented for directing a first flow of wash fluid towards or into rack assembly 200. In the exemplary embodiment shown in FIGS. 3 and 4, first spray assembly 222 may be a spray arm, such as mid-level spray assembly 148 of dishwasher appliance 100. Thus, first spray assembly 222 may be a spray arm rotatably mounted to rack assembly 200 at bottom wall 210 of rack assembly 200. In particular, first spray assembly 222 may be positioned below bottom wall 210 of rack assembly 200, e.g., along the vertical direction V, and direct the first flow of wash fluid towards or into rack assembly 200 through bottom wall 210.

Second spray assembly 224 is positioned and/or oriented for directing a second flow of wash fluid towards or into rack assembly 200. In particular, as shown in FIGS. 3 and 4, second spray assembly 224 is a bottle washer assembly 240. Bottle washer assembly 240 is mounted to rack assembly 200 at bottom wall 210 of rack assembly 200. Bottle washer assembly 240 includes one or more spray tines 242. Articles, and in particulars bottles (such as baby bottles), cups, glasses, etc., may be positioned on and/or over spray tines 242. Spray tines 242 are mounted to a main conduit 246 of the bottle washer assembly 240 and can extend into interior volume 206 of rack assembly 200, e.g., upwardly along the vertical direction V. In particular, spray tines 242 of bottle washer assembly 240 may be distributed between fixed tines 219 of bottom wall 210. For example, each spray tine 242 of bottle washer assembly 240 may be positioned between respective pairs of fixed tines 219 as shown in FIGS. 3 and 4.

Spray tines 242 may assist with supporting articles within interior volume 206 of rack assembly 200. In addition, each spray tine 242 may emit a stream of wash fluid during operation of bottle washer assembly 240. The stream of wash fluid is directed against or onto an article positioned over or on each respective one of spray tines 242. In such a manner, bottles and other containers may be washed or cleaned during operation of dishwasher appliance 100.

Bottle washer assembly 240 also includes one or more clips 244. Each clip 244 is positioned and/or mounted to a respective one of spray tines 242. Clips 244 engage articles disposed on or over spray tines 242 and hinder or prevent such articles from moving during operation of bottler washer assembly 240. Thus, as an example, when a stream of fluid from one of spray tines 242 impacts a bottle disposed over the one of spray tines 242, an associated one of clips 244 hinders or prevents the bottle from being ejected off the one of spray tines 242 by the stream of fluid.

To provide wash fluid to first spray assembly 222 and second spray assembly 224, rack assembly 200 includes a supply conduit 220. Supply conduit 220 is configured for receiving wash fluid during operation of an associated dishwasher appliance 100 and directing such wash fluid to first spray assembly 222 and/or second spray assembly 224. For example, supply conduit 220 may be in fluid communication with the fluid circulation assembly of dishwasher appliance 100 when rack assembly 200 is in a closed position. Thus, the fluid circulation assembly of dishwasher appliance 100, e.g. a pump of the fluid circulation assembly, may direct wash fluid from tub sump portion 142 of tub 104 to supply conduit 220 during operation of dishwasher appliance 100.

Supply conduit 220 includes a first segment 230 that extends to or towards first spray assembly 222 and a second segment 232 that extends to or towards second spray assembly 224. First segment 230 of supply conduit 220 directs wash fluid therethrough to first spray assembly 222, e.g., during operation of dishwasher appliance 100. Second segment 232 of supply conduit 220 is configured for directing wash fluid to second spray assembly 224, e.g., during operation of dishwasher appliance 100. (It should be noted that second segment 232 is shown in an exploded position in FIG. 3 for illustrative purposes only).

Referring now to FIGS. 5 through 8, embodiments of bottle washer assemblies 240 in accordance with the present disclosure are illustrated. As discussed, a bottle washer assembly 240 may include one or more spray tines 242, each of which may be in selective fluid communication with main conduit 246, such as with a main passage 247 (see FIG. 3) defined in the main conduit 246. Wash fluid may thus be selectively flowed through each spray tine 242 from the main conduit 246, and may be exhausted from each spray tine 242 generally into the wash chamber 106. The wash fluid may be flowed, for example, from supply conduit 220, such as second segment 232 thereof, into main passage 247 of main conduit 246. The wash fluid in main passage 247 may then be flowed therethrough, and may selectively be flowed into and through spray tines 242 as discussed herein. Advantageously, as discussed herein, one or more spray tines 242 may further be movable between a first position wherein wash fluid is permitted to flow into and through the spray tine 242 for emission therefrom and a second position wherein wash fluid is restricted or generally prevented from flowing into and through the spray tine 242 for emission therefrom. Further, one or more spray tines 242 may, when in the second position, be in generally unobtrusive positions relative to their first positions for a user loading articles in a dishwasher appliance 100.

As illustrated, a spray tine 242 in accordance with the present disclosure may include a conduit 250. The conduit 250 may, for example, extend between a first end 252 and a second end 254. First end 252 may connect, either directly or indirectly, to the supply conduit 246, and second end 254 may be spaced from the first end 252. Conduit 250 may further define a passage 256 extending therethrough between first end 252 and second end 254. The passage 256 may be in selective fluid communication with the main passage 247 of the supply conduit 246, as discussed herein. Accordingly, wash fluid may selectively flow from the main passage 247 into the passage 256 of the conduit 250 at the first end 252, and exit the passage 256 of the conduit 250 at the second end 254 thereof.

In some embodiments, each spray tine 242 may be directly connected to the main conduit 246, such that the passage 256 and main passage 247 are in direct selective fluid communication. Alternatively and as shown, in some embodiments, each spray tine 242 may be indirectly connected to the main conduit 246, such that the passage 256 and main passage 247 are in indirect selective fluid communication. For example, bottle washer assembly 240 further includes one or more auxiliary conduits 260. Each auxiliary conduit 260 may extend between the main conduit 246 and a spray tine 242, such as the conduit 250 and first end 252 thereof. Each auxiliary conduit 260 may define an auxiliary passage 262 therethrough. The auxiliary passage 262 may be in fluid communication with the main passage 247 and in selective fluid communication with the passage 256, as discussed herein, and may thus provide the selective fluid communication between main passage 247 and passage 256.

In exemplary embodiments as shown, a longitudinal axis 268 of an auxiliary conduit 260 may extend perpendicularly to a longitudinal axis 248 of the main conduit 246. Alternatively, longitudinal axis 268 may extend at any suitable non-zero angle to longitudinal axis 248.

A spray tine 242 may further include a cap 280. The cap 280 may be mounted to the conduit 250, such as to the second end 254 thereof. Cap 280 may further define a plurality of outlet apertures 282 through which wash fluid may be exhausted from the spray tine 242 into the wash chamber 106. Accordingly, wash fluid may flow from the second end 254 of the conduit into the cap 280, and from the cap 280 into the wash chamber 106 through the outlet apertures 282.

Figure 6:
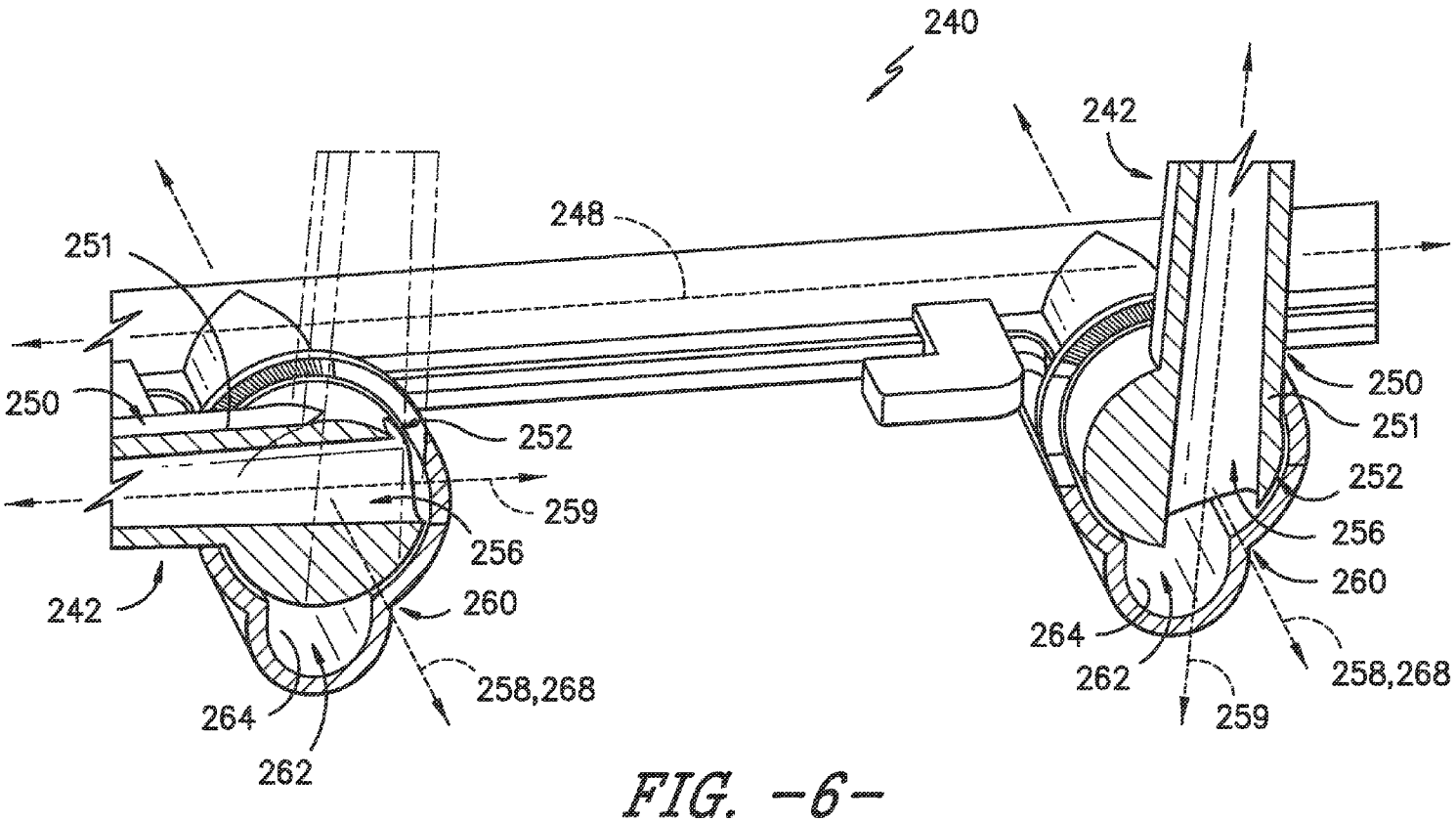
FIG. 6 provides a cross-sectional view of components of a bottle washer assembly, with conduits of spray tines in first and second positions, in accordance with one embodiment of the present disclosure.

As particularly illustrated in FIG. 6, a conduit 250 of a spray tine 242 in accordance with the present disclosure may be movable between a first position and a second position. For example, as shown, the conduit 250 may be rotatable, such as about a rotational axis 258 between the first position and the second position. FIG. 6 illustrates one conduit 250 rotated to a first position and another conduit 250 rotated to a second position. In some embodiments, a rotational angle between the first position and the second position is between approximately 80 degrees and approximately 100 degrees, such as approximately 90 degrees. In alternative embodiments, the rotational angle between the first position and the second position may be any suitable non-zero angle. The conduit 250 may thus be rotatable through such angle between the first position and the second position.

The rotational axis 258 may, for example, extend approximately perpendicular to the longitudinal axis 248 of the main conduit 246. In exemplary embodiments, for example, the rotational axis 258 and the longitudinal axis 268 of the auxiliary conduit 260 may be co-axial.

Further, a longitudinal axis 259 of conduit 250 may, when in the first position, be generally parallel to the vertical direction V. The longitudinal axis 259 may further be generally perpendicular to the longitudinal axes 248, 268 when in the first position. Longitudinal axis 259 may, when in the second position, be generally parallel to the longitudinal axis 248 as shown.

In the first position, wash fluid flow into the passage 256 of the conduit 250 may be permitted. For example, as illustrated in FIG. 6, in the first position the passage 256 at the first end 252 may be in direct fluid communication with the auxiliary passage 262. In alternative embodiments wherein an auxiliary passage 262 is not utilized, the passage 256 at the first end 252 in the first position 252 may be in direct fluid communication with the main passage 247. Accordingly, in the first position the passage 256 is generally in fluid communication with the main passage 247. In the second position, wash fluid flow into the passage 256 of the conduit 250 may be restricted or generally prevented. For example, as further illustrated in FIG. 6, the passage 256 at the first end 252 is moved, such as rotated, from the first position such that the direct fluid communication with the auxiliary passage 262 or main passage 247 is reduced or generally broken. Wash fluid flowing through the main passage 247 or auxiliary passage 262 is thus restricted or prevented from flowing into the passage 256 at the first end 252. Accordingly, in the second position fluid communication between the passage 256 and main passage 247 is generally restricted or prevented.

The reduction or prevention of wash fluid flow through spray tines 242 advantageously allows for increased wash fluid flow to other components of the dishwasher appliance 100, such as the first spray assembly 222 and other various spray assemblies, when the spray tines 242 are not in use. Additionally, the positioning of the spray tines 242 when in their second positions may, as illustrated, be advantageously relatively unobtrusive relative to the first positions, thus facilitating easier dishwasher appliance 100 loading for a user when the spray tines 242 are not being utilized.

Figure 8:
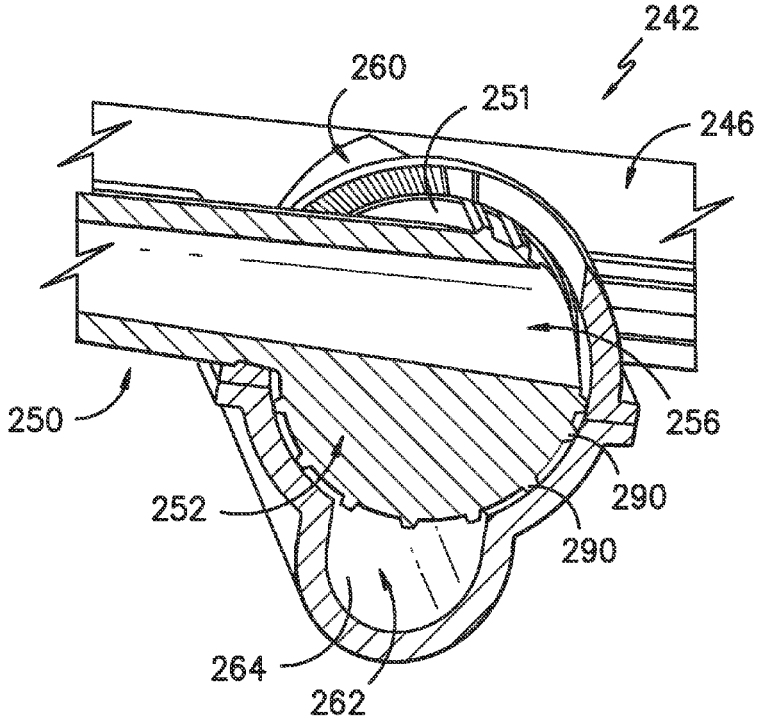
FIG. 8 provides a close-up cross-sectional view of a portion of a bottle washer assembly in accordance with one embodiment of the present disclosure.

As illustrated, the restriction or prevention of fluid communication may be provided by an outer surface 251 of the conduit 250, a portion of which may in the second position be disposed within the flow path of wash fluid through the main passage 247 or auxiliary passage 262. The wash fluid may thus contact the outer surface 251 and be restricted or prevented from flowing into the passage 256 defined in the conduit 250. Further, in some embodiments as illustrated in FIG. 8, a spray tine 242 may further include a plurality of ribs 290. Each rib 290 may extend from the outer surface 251 of the conduit 250. One or more ribs 290 may further, for example, contact an inner surface 264 of the auxiliary conduit 260 or an inner surface of the main conduit 246 when the conduit 250 is in the second position. These ribs 290, due for example to the contact with the inner surface 264, may further reduce or prevent wash fluid from flowing into the passage 256 by reducing or preventing flow around the outer surface 251 to the passage 256 at the first end 252.

Figure 7:
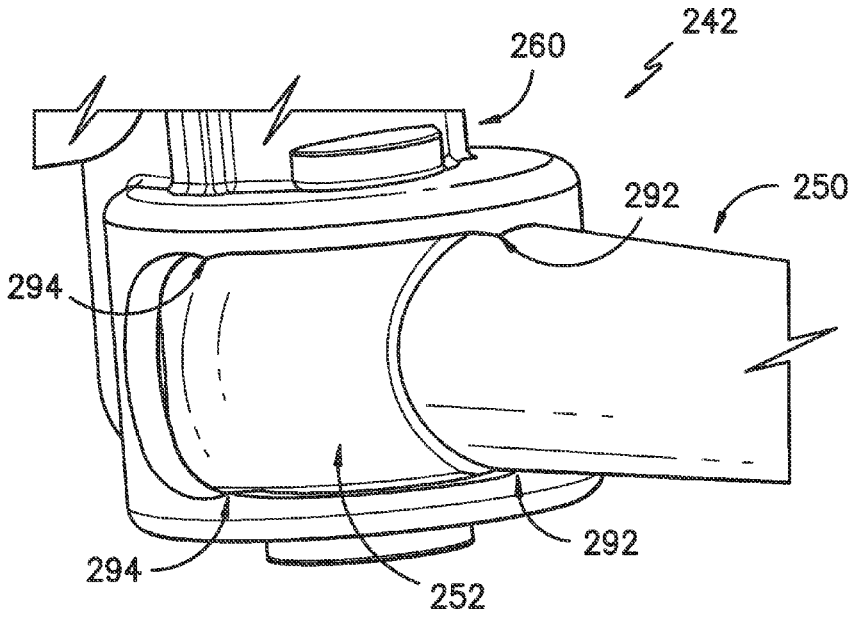
FIG. 7 provides a close-up perspective view of a portion of a bottle washer assembly in accordance with one embodiment of the present disclosure.

Referring now to FIG. 7, bottle washer assembly 240 may include one or more first detents 292 and one or more second detents 294. The detents 292, 294 may be configured to seat the conduit 250 in the first position and the second position, respectively. For example, first detents 292 and second detents 294 may be configured on the auxiliary conduit 260 as shown or the main conduit 246. In exemplary embodiments, the detents 292, 294 may be protrusions extending from the auxiliary conduit 260 as shown or the main conduit 246. As the conduit 250 is moved to the first position, the conduit 250 may move past and contact first detents 292. The first detents 292 may be positioned such that the conduit 250 is in the first position after passing the first detents 292 in a direction towards the first position. The first detents 292 may further restrict movement by the conduit 250 past the first detents 292, due for example to the contact therebetween, such that the first detents 292 operate to seat the conduit 250 in the first position after it has passed the first detents 292 in a direction towards the first position. Similarly, as the conduit 250 is moved to the second position, the conduit 250 may move past and contact second detents 294. The second detents 294 may be positioned such that the conduit 250 is in the second position after passing the second detents 295 in a direction towards the second position. The second detents 294 may further restrict movement by the conduit 250 past the second detents 294, due for example to the contact therebetween, such that the second detents 294 operate to seat the conduit 250 in the second position after it has passed the second detents 294 in a direction towards the second position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A bottle washer assembly for a dishwasher appliance, the bottle washer assembly comprising:

a main conduit defining a main passage for flowing wash fluid therethrough;

a spray tine, the spray tine comprising a conduit defining a passage along an inner surface for flowing wash fluid therethrough, the passage in selective fluid communication with the main passage; and an auxiliary conduit extending between the main conduit and the conduit, the auxiliary conduit defining an auxiliary passage in fluid communication with the main passage and selective fluid communication with the passage, wherein the conduit is movable between a first position wherein wash fluid flow into the passage is permitted and a second position wherein wash fluid flow into the passage is restricted relative to the wash fluid flow in the first position, and wherein the spray tine includes an outer surface opposite the inner surface and extending from a first end to a second end, at least a portion of the outer surface including a plurality of ribs and being rotatably positioned within the auxiliary conduit at the first end, wherein one or more ribs of the plurality of ribs are in contact with the auxiliary conduit in the second position, wherein the portion of the outer surface including the plurality of ribs is positioned within the auxiliary conduit in the second position, and wherein at least two ribs of the plurality of ribs are positioned at opposite sides of the passage and prevent wash fluid flow into the passage above the auxiliary passage in the second position.

2. The bottle washer assembly of claim 1, wherein the conduit is rotatable between the first position and the second position.

3. The bottle washer assembly of claim 2, wherein a rotational axis about which the conduit is rotatable extends generally perpendicular to a longitudinal axis of the main conduit.

4. The bottle washer assembly of claim 2, wherein the conduit is rotatable approximately 90 degrees between the first position and the second position.

5. The bottle washer assembly of claim 1, further comprising a first detent configured to seat the conduit in the first position and a second detent configured to seat the conduit in the second position.

6. The bottle washer assembly of claim 5, wherein the first detent and second detent are protrusions.

7. The bottle washer assembly of claim 1, wherein wash fluid flow into the passage is generally prevented in the second position.

8. The bottle washer assembly of claim 1, wherein the at least one spray tine further comprises a cap, the cap defining a plurality of outlet apertures.

9. The bottle washer assembly of claim 1, further comprising at least one clip.

10. The bottle washer assembly of claim 1, wherein the spray tine is a plurality of spray tines.

11. A dishwasher appliance, comprising:

a tub defining a wash chamber;

a rack assembly disposed within the wash chamber of the tub;

a first spray assembly positioned adjacent the rack assembly; and a second spray assembly positioned adjacent the rack assembly, wherein the second spray assembly is a bottle washer assembly, the bottle washer assembly comprising:

a main conduit defining a main passage for flowing wash fluid therethrough;

a spray tine, the spray tine comprising a conduit defining a passage along an inner surface for flowing wash fluid therethrough, the passage in selective fluid communication with the main passage; and an auxiliary conduit extending between the main conduit and the conduit, the auxiliary conduit defining an auxiliary passage in fluid communication with the main passage and selective fluid communication with the passage, wherein the conduit is movable between a first position wherein wash fluid flow into the passage is permitted and a second position wherein wash fluid flow into the passage is restricted relative to the wash fluid flow in the first position, and wherein the spray tine includes an outer surface opposite the inner surface and extending from a first end to a second end, at least a portion of the outer surface including a plurality of ribs and being rotatably positioned within the auxiliary conduit at the first end, wherein one or more ribs of the plurality of ribs are in contact with the auxiliary conduit in the second position, wherein the portion of the outer surface including the plurality of ribs is positioned within the auxiliary conduit in the second position, and wherein at least two ribs of the plurality of ribs are positioned at opposite sides of the passage and prevent wash fluid flow into the passage above the auxiliary passage in the second position.

12. The dishwasher appliance of claim 11, wherein the conduit is rotatable between the first position and the second position.

13. The dishwasher appliance of claim 11, further comprising a first detent configured to seat the conduit in the first position and a second detent configured to seat the conduit in the second position.

14. The dishwasher appliance of claim 11, wherein wash fluid flow into the passage is generally prevented in the second position.

15. The dishwasher appliance of claim 11, wherein the at least one spray tine further comprises a cap, the cap defining a plurality of outlet apertures.

16. The dishwasher appliance of claim 11, further comprising at least one clip.

17. A dishwasher appliance, comprising:

a tub defining a wash chamber;

a rack assembly disposed within the wash chamber of the tub;

a first spray assembly positioned adjacent the rack assembly; and a second spray assembly positioned adjacent the rack assembly, wherein the second spray assembly is a bottle washer assembly, the bottle washer assembly comprising:

a main conduit defining a main passage for flowing wash fluid therethrough;

a spray tine, the spray tine comprising a conduit defining a passage for flowing wash fluid therethrough, the passage in selective fluid communication with the main passage; and an auxiliary conduit extending between the main conduit and the conduit, the auxiliary conduit defining an auxiliary passage in fluid communication with the main passage and selective fluid communication with the passage, wherein the conduit is movable between a first position wherein wash fluid flow into the passage is permitted and a second position wherein wash fluid flow into the passage is restricted relative to the wash fluid flow in the first position, wherein the spray tine includes an outer surface opposite the inner surface and extending from a first end to a second end, at least a portion of the outer surface including a plurality of ribs and being rotatably positioned within the auxiliary conduit at the first end, wherein one or more ribs of the plurality of ribs are in contact with the auxiliary conduit in the second position, wherein the portion of the outer surface including the plurality of ribs is positioned within the auxiliary conduit in the second position, wherein at least two ribs of the plurality of ribs are positioned at opposite sides of the passage and prevent wash fluid flow into the passage above the auxiliary passage in the second position, and wherein the outer surface includes a radial first detent protrusion configured to seat the conduit in the first position and a radial second detent protrusion configured to seat the conduit in the second position.

* * * * *